US007079795B2

(12) United States Patent
Hibino

(10) Patent No.: US 7,079,795 B2
(45) Date of Patent: Jul. 18, 2006

(54) IMAGE FORMING APPARATUS

(75) Inventor: Masaru Hibino, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/114,180

(22) Filed: Apr. 26, 2005

(65) Prior Publication Data

US 2005/0238391 A1 Oct. 27, 2005

(30) Foreign Application Priority Data

Apr. 26, 2004 (JP) ..... 2004-130319

(51) Int. Cl.
*G03G 15/09* (2006.01)

(52) U.S. Cl. ..... 399/267; 399/269; 430/111.41; 430/111.1

(58) Field of Classification Search ..... 430/111.41, 430/111.1; 399/267, 269
See application file for complete search history.

(56) References Cited

U.S. PATENT DOCUMENTS 5,462,828 A * 10/1995 Moffat et al. ..... 430/109.3
6,096,466 A * 8/2000 Imai et al. ..... 430/111.1
2003/0022089 A1* 1/2003 Veregin et al. ..... 430/111.41

* cited by examiner

*Primary Examiner*—David M. Gray
*Assistant Examiner*—Erika Villaluna
(74) *Attorney, Agent, or Firm*—Fitzpatrick, Cella, Harper & Scinto

(57) ABSTRACT

An image forming apparatus includes an image bearing member having a surface on which an electrostatic latent image is to be formed; a black developing device, containing a black developer including toner and carrier, for developing the electrostatic latent image; at least one color developing device containing a color developer having a color other than black; a supplying device, provided for each of the black developing device and the color developing device, for supplying a supply material containing toner and carrier; a discharging device for discharging the developer. A resistivity of the carrier contained in the black developer is higher than resistivity of the carrier contained in the color developer, and a weight percentage of the carrier contained in the supply material for the black developing device is higher than a weight percentage of the carrier contained in the supply material for the color developing device.

3 Claims, 4 Drawing Sheets

IMAGE FORMING APPARATUS

FIELD OF THE INVENTION AND RELATED ART

The present invention relates to an image forming apparatus such as a copying machine, a printer, a recorded image displaying apparatus, a facsimile machine, etc., which forms a visible image by developing an electrostatic latent image formed on an image bearing member with the use of an electrophotographic, electrostatic, or the like recording method. In particular, it relates to a color image forming apparatus, which forms an image with the use of a plurality of developers different in color, including black toner, and which is equipped with a means for supplying the developing apparatuses with developer.

In the field of an image forming apparatus, the electrophotographic image forming method has been known. According to this image forming method, an image bearing member is uniformly charged, and an electrostatic latent image is formed on the charged surface of the image bearing member, by changing in potential level numerous points of the charged surface of the image bearing member by exposing the charged surface. Then, the latent image is developed with the use of developer to yield a visible image.

As for the developing method compatible with this image forming method, various developing methods are available. However, the two-component developing method (two-component magnetic brush developing method) is the most commonly used developing method (for example, Japanese Laid-open Patent Application 6-19222). According to this developing method, the two-component developer, which is a mixture of nonmagnetic toner and magnetic carrier, is conveyed by a development sleeve, as a rotatable, cylindrical, and electrically conductive developer bearing member, in the hollow of which a magnetic field generating stationary means is disposed, to the location where the distance between the development sleeve and image bearing member is smallest, that is, small enough for the layer of developer (magnetic brush) on the peripheral surface of the development sleeve to come into contact with the peripheral surface of the image bearing member, and where an electric field is formed. As a result, the electrostatic latent image on the peripheral surface of the image bearing member is developed into a visible image. In terms of image quality (graininess and uniformity) and operational stability, this developing method is substantially superior to the comparative developing methods, because of the presence of the carrier, that is, particulate substance, as means for ensuring that toner is given a sufficient amount of triboelectric charge, in the developer.

In recent years, full-colorization, systematization, and digitalization have been progressing in the field of an electrophotographic image forming apparatus such as a copying machine, a printer, etc. With the progresses in the abovementioned aspects of an electrophotographic image forming apparatus, the quality of an black image has been increasing in importance. Regarding the positioning of a black image in a system for forming a full-color image, a system for forming a full-color image has come to be required to be excellent not only in the formation of monochromatic color images, but also, in the formation of a black image, in terms of various factors which affect image quality, that is, it has come to be required to be excellent in the formation of a black image, not only in terms of the reproduction of letters, but also, in terms of the uniformity in the density of the solid portions of an image, graininess of the low density portions of an image, amount of fog, etc.

On the other hand, it is required to be excellent in terms of the blackness of a black image, which is the fundamental property of a black image.

Various substances have been proposed as the pigment for black developer used for the formation of a black image. However, the method of dispersing carbon black as pigment in the toner of two-component developer in order to form a blacker image, has been well-known, and is very effective.

However, increasing the carbon black contents to form a blacker image results in the formation of a black image suffering from fog, scattering of black toner, or the like problems. It also results in the formation of a black image which is drastically inferior in quality to images formed of any of the color toners. These problems are particularly conspicuous when ambient humidity is relatively high.

The causes of the abovementioned problems are as follows. That is, there are various kinds of carbon black, which are different in particle size, electrical resistance, oil absorption, etc. However, all of them are high in electrical conductivity. Therefore, when a mixture of carrier, and black toner in which carbon black has been dispersed, is used as two-component developer, the greater the amount of the carbon black dispersed in the toner, the smaller the toner in terms of the absolute value of the triboelectrical charge given to the toner by the friction between the toner and carrier, and also, the lower the developer in terms of electrical charge retention.

As for the countermeasure for the above-described problems, employing a carrier higher in resistivity than the carrier contained in color developer, as the carrier for black developer, has been proposed, and has been put to use. Increasing carrier in electrical resistance improves the carrier in terms of the ability to electrically charge toner, making it possible to prevent the above-described problems.

However, in the tests in which a black toner containing carbon black was used as the black toner for the developer for a color image forming apparatus, and also, in which a carrier high in electrical resistance value was used as the carrier for the developer for the color image forming apparatus, as described above, in order to deal with the problem that the usage of carbon black as the pigment for black toner reduced the black toner in terms of the absolute value of the potential level to which the toner was charged, a target level of image quality was achieved only during the initial period of the image forming operation; in other words, the achievable level of image quality substantially fell as the image forming operation continued.

As for the cause of the developer deterioration, increasing a carrier in electrical resistance to improve the carrier in its ability to electrically charge toner makes it easier for the external additive added to the toner to adjust the toner in electrical charge, to adhere to the carrier. As the external additives adhere to the surfaces of the carrier particles, toner particles are adhered to the carrier particle surfaces (toner is spent), with the external additives acting as nuclei. Obviously, as toner particles are adhered to the surfaces of carrier particles, the carrier is reduced in the ability to electrically charge the toner, resulting in the scattering of toner, formation of images of poor quality, for example, images suffering from fog or the like defects.

SUMMARY OF THE INVENTION

The primary object of the present invention, which is related to an image forming operation in which black developer, is used to provide an image forming apparatus capable of forming a black image equal in quality to any of monochromatic color images formed with the use of color developers, and also, capable of continuously forming such black images for a long period of time. More specifically, it is to provide an image forming apparatus capable of continuously forming black images equal in terms of general quality, more specifically, amount of fog, amount by which toner scatters, vividness, graininess, uniformity, etc., to any of monochromatic color images formed with the use of color developers, for a long period of time, even when ambient humidity is relatively high.

According to an aspect of the present invention, there is provided an image forming apparatus comprising an image bearing member having a surface on which an electrostatic latent image is to be formed; a black developing device, containing a black developer comprising toner and carrier, for developing the electrostatic latent image; at least one color developing device containing a color developer having a color other than black; supplying means, provided for each of said black developing device and said color developing device, for supplying supply material containing toner and carrier; discharging means for discharging the developer, wherein a resistivity of the carrier contained in the black developer in said black developing device is higher than a resistivity of the carrier contained in the color developer in said color developing device, and a weight percentage of the carrier contained in the supply material for said black developing device is higher than a weight percentage of the carrier contained in the supply material for said color developing device.

In one of the embodiments of the present invention, the black developer, and the replenishment black developer supplied to the black developing apparatus, contain carbon black as pigment.

In another embodiment of the present invention, the specific resistance of the carrier contained in the black developer is no less than $1.0\times10^{9}$ and no more than $1.0\times10^{10}$, and the specific resistance of the carrier contained in each of the color developers is no less than $1.0\times10^{7}$ and no more than $1.0\times10^{9}$. Further, the carrier ratio of the replenishment black developer to be supplied to the black developing apparatus is in the range of 10–40 wt. %, and the carrier ratio of each of the replenishment color developers to be supplied to the color developing apparatuses is in the range of 1–15 wt. %. Or, the black developing apparatus and each of the plurality of color developing apparatuses are provided with a plurality of developer bearing members for conveying developer to the surface of an image bearing member, and the specific resistance of the carrier contained in the black developer is no less than $1.0\times10^{9}$ and no more than $1.0\times10^{12}$, and the specific resistance of the carrier contained in each of the color developers is no less than $1.0\times10^{7}$ and no more than $1.0\times10^{9}$, whereas the carrier ratio of the replenishment black developer to be supplied to the black developing apparatus is in the range of 10–25 wt. %, and the carrier ratio of each of the replenishment color developers to be supplied to the color developing apparatuses is in the range of 1–15 wt. %.

The image forming apparatus in accordance with the present invention comprises: an image bearing member, on the peripheral surface of which an electrostatic latent image is formed; a black developing apparatus which develops the electrostatic latent image, and stores, as developer, black developer made up essentially of toner and carrier; one or more monochromatic color developing apparatuses which store color developer, that is, developer other than black developer; a plurality of replenishing means provided one for each of the developing apparatuses to replenish each of the developing apparatuses with replenishment developers made up of essentially toner and carrier; a plurality of discharging means provided one for each of the developing apparatuses to discharge the developer from the developing apparatuses. Further, the specific resistance of the carrier contained in the black developer in the black developing apparatus is made higher than the specific resistance of the carrier in each of the color developers in the color developing apparatuses, and weight ratio of the carrier of the replenishment developer supplied to the black developing apparatus is made higher than the weight ratio of the carrier of each of the replenishment carriers supplied to the color developing apparatuses. Therefore, the carrier used with black toner is higher in the ability to electrically charge toner than the carrier used with each of the color toners. Further, the developer(s) in the developing apparatus which uses a toner containing carbon black, as the black toner for the black developer, is automatically replaced to prevent the toner-spent phenomenon, that is, the phenomenon that the external additives for toner adhere to the surfaces of the carrier particles. Therefore, it is possible to prevent the formation of images suffering from fog, and the scattering of toner. Therefore, the image forming apparatus in accordance with the present invention can continuously yield images of high quality for a long period of time.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described in more detail with reference to the appended drawings.

Embodiment 1

Figure 3:
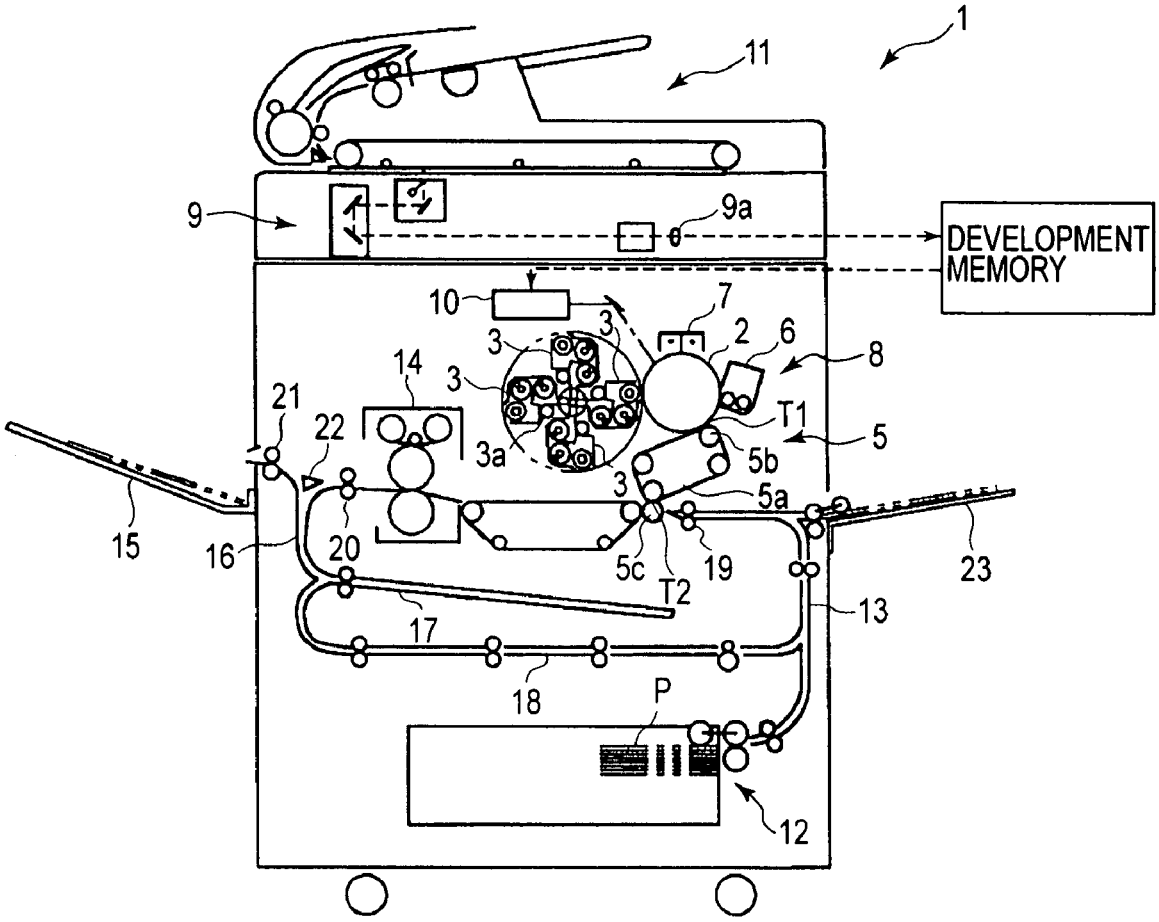
FIG. 3 is a sectional view of one of the image forming apparatuses in accordance with the present invention, showing the general structure thereof.

The present invention can be realized in the form of the image forming apparatus 1 structured as shown in FIG. 3. FIG. 3 is a schematic sectional view of the image forming apparatus 1, that is, an electrophotographic copying machine, showing the general structure thereof.

This image forming apparatus 1 has an electrophotographic photosensitive member in the form of a drum or a belt, as an image bearing member, which is a photosensitive drum 2 in this embodiment. While the photosensitive drum 2 is rotated, an image is formed of developer, on the peripheral surface of the photosensitive drum 2 by an image forming means disposed in the adjacencies of the peripheral surface of photosensitive drum 2 in a manner of surrounding the photosensitive drum 2. The photosensitive drum 2 and the image forming means disposed in the adjacencies of the peripheral surface of the photosensitive drum 2 may together be referred to as image forming portion 8.

An original as the source of the external data is guided to an optical reading system 9 by an original processing apparatus 11. The optical reading system 9 is such a means that obtains image formation data by reading the original, and generates image formation signals which are to be sent to the image forming portion 8; image formation data are read by a CCD 9*a*.

In the image forming portion 8, the peripheral surface of the photosensitive drum 2 is uniformly charged by a primary charging device 7, and the uniformly charged peripheral surface of the photosensitive drum 2 is exposed by an exposing portion 10, in accordance with the image formation data sent from the optical reading system 9. As a result, a latent image is formed on the peripheral surface of the photosensitive drum 2. The latent image on the photosensitive drum 2 is visualized by adhering developer (toner) to the peripheral surface of the photosensitive drum 2 in the pattern of the latent image by a developing apparatus 3; in other words, the latent image is developed into an image formed of developer (toner), which hereinafter may be referred to simply as a developer image (toner image).

Referring to FIG. 3, the image forming apparatus 1 is provided with four developing apparatuses 3 different in the color of the developer they use. The four developing apparatuses 3 are mounted in a rotary 3*a* with the provision of equal intervals. The rotation of the rotary 3*a* is controlled so that when developing the latent image into a developer image of a given color, the developing apparatus 3 which contains the toner of the given color is moved into the position in which it opposes the photosensitive drum 2. The image forming apparatus 1 is also provided with four hoppers, which are disposed in the rotary 3*a*, being paired with the four developing apparatuses, one for one. Each hopper constitutes a means for replenishing the corresponding developing apparatus 3 with replenishment developer which is smaller in carrier ratio than the original developer in the developing apparatus 3. This replenishing means will be described later in more detail.

As the photosensitive drum 2 is rotated, the toner image formed on the peripheral surface of the photosensitive drum 2, through the above-described steps, is moved to a primary transferring portion T1 in which the toner image is transferred onto an intermediary transferring member 5*a*.

As for the function of the transferring apparatus 5 comprising the intermediary transferring member 5*a*, four toner images different in color are deposited in layers on the intermediary transferring member 5*a*, forming a single color image, by sequentially repeating the process of forming a toner image on the peripheral surface of the photosensitive drum 2, with the use of one of the developing apparatuses 3, and transferring (first transfer) the formed toner image from the peripheral surface of the photosensitive drum 2 onto the intermediary transferring member 5*a*, is sequentially repeated four times, once for each color, and then, the four toner images different in color, which makes up the single color image, are transferred all at once onto a sheet P as a recording medium, as will be described later.

After the formation of each of the four images different in color, more specifically, after the primary transfer of each toner image, the peripheral surface of the photosensitive drum 2 is cleared of the transfer residual developer by a cleaning apparatus 6 to prepare the peripheral surface of the photosensitive drum 2 for the formation of the toner image of the next color.

Meanwhile, the sheet P is sent to the image forming portion 8 from a sheet feeding/conveying portion 12. When the sheet P is a special purpose sheet, for example, OHT, thick paper, or the like, it is fed from a manual feeding tray 23. The sheet P fed from the manual feeding tray 23 is directly delivered to a pair of registration rollers 19, whereas the sheet P fed through the sheet feeding/conveying portion 12 is first conveyed through the main assembly sheet path 13, and then, is delivered to the pair of registration rollers 19. Then, the sheet P is sent to the nip between the intermediary transferring belt 5*a* and a second transferring means 5*c*. The intermediary transferring belt 5*a* and second transferring means 5*c* together constitute the transferring apparatus 5.

The transferring apparatus 5 comprises the intermediary transferring member 5*a*, a primary transfer roller 5*b* as a primary transferring means, and a second transfer roller 5*c* as a second transferring means. The intermediary transferring member 5*a* is an image bearing member onto which the aforementioned four toner images different in color are transferred in layers in the primary transfer step. In this embodiment, it is in the form of a movable belt. In the primary transfer portion T1 in which the intermediary transferring member 5*a* is in contact with the peripheral surface of the photosensitive drum 2, the primary transfer roller 5*b* is disposed on the inward side of the loop which the belt forms. As a primary transfer bias is applied to the primary transfer roller 5*b* from an unshown electrical power source, the toner image is transferred (primary transfer) onto the intermediary transferring member 5*a* from the photosensitive drum 2 as described before. The compound toner image made up of the four toner images different in color having been sequentially transferred (primary transfer) onto the intermediary transferring member 5*a* in the primary transfer portion T1 is conveyed by the movement of the intermediary transferring member 5*a* to the nip between the intermediary transferring member 5*a* and the second transferring roller 5*c* as the second transferring means, which is one of the structural components of the transferring apparatus 5.

In the second transfer portion T2, that is, the nip between the intermediary transferring member 5*a* and second transfer roller 5*c*, a second transfer bias is applied to the second transfer roller 5*c* from an unshown electrical power source, and as the second transfer bias is applied, the layered four toner images, making up a single color image, are transferred all once (second transfer) onto the sheet P having just been delivered to the second transfer portion T2.

Thereafter, the sheet P is conveyed to a fixing apparatus 14, in which the process of fixing the toner images to the sheet P is carried out to yield a permanent copy of the original.

After the completion of the formation of a permanent copy of the original on the sheet P, the sheet P is further conveyed by an inward pair of discharge rollers 20, and is guided by a flapper 22 into a path which leads to a sheet discharge portion 15 through which it is discharged from the image forming apparatus by an outward pair of discharge rollers 21, or into a re-feeding path 16 through which it is re-fed into the image forming apparatus when the apparatus is in the two-sided recording mode. As the sheet P is guided into the re-feeding path 16, it is placed upside down by a reversing path 17, and then, is guided into the two-sided recording path 18 so that it will be sent to the pair of registration rollers 19 for the second time to be sent to the second transfer portion T2.

Figure 1:
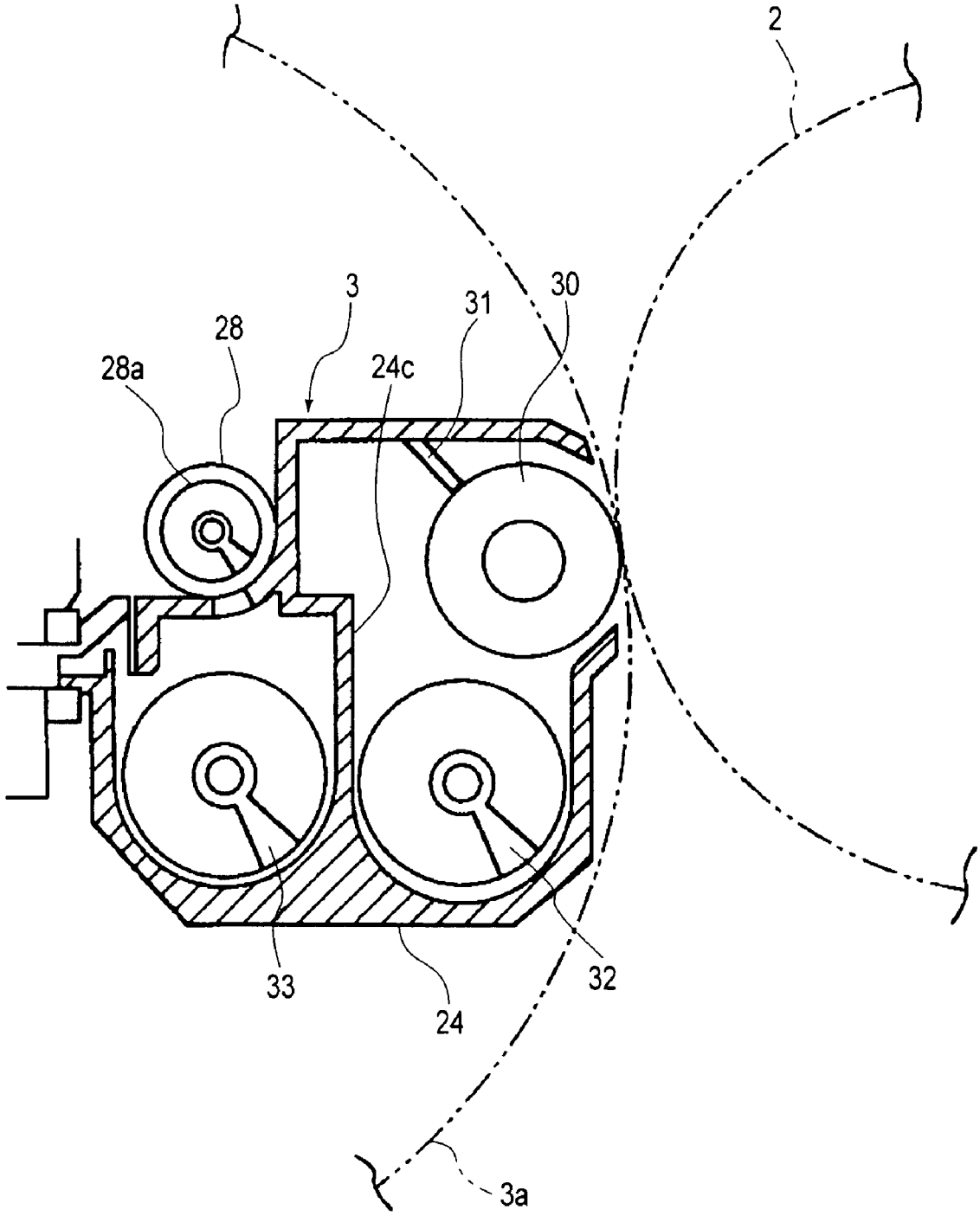
FIG. 1 is a sectional view of one of the developing apparatuses in accordance with the present invention.

Next, referring to FIG. 1, the developing apparatus 3 will be described. Incidentally, the four developing apparatuses 3 with which the image forming apparatus 1 is provided are identical (in structure) except for developer color.

Figure 2:
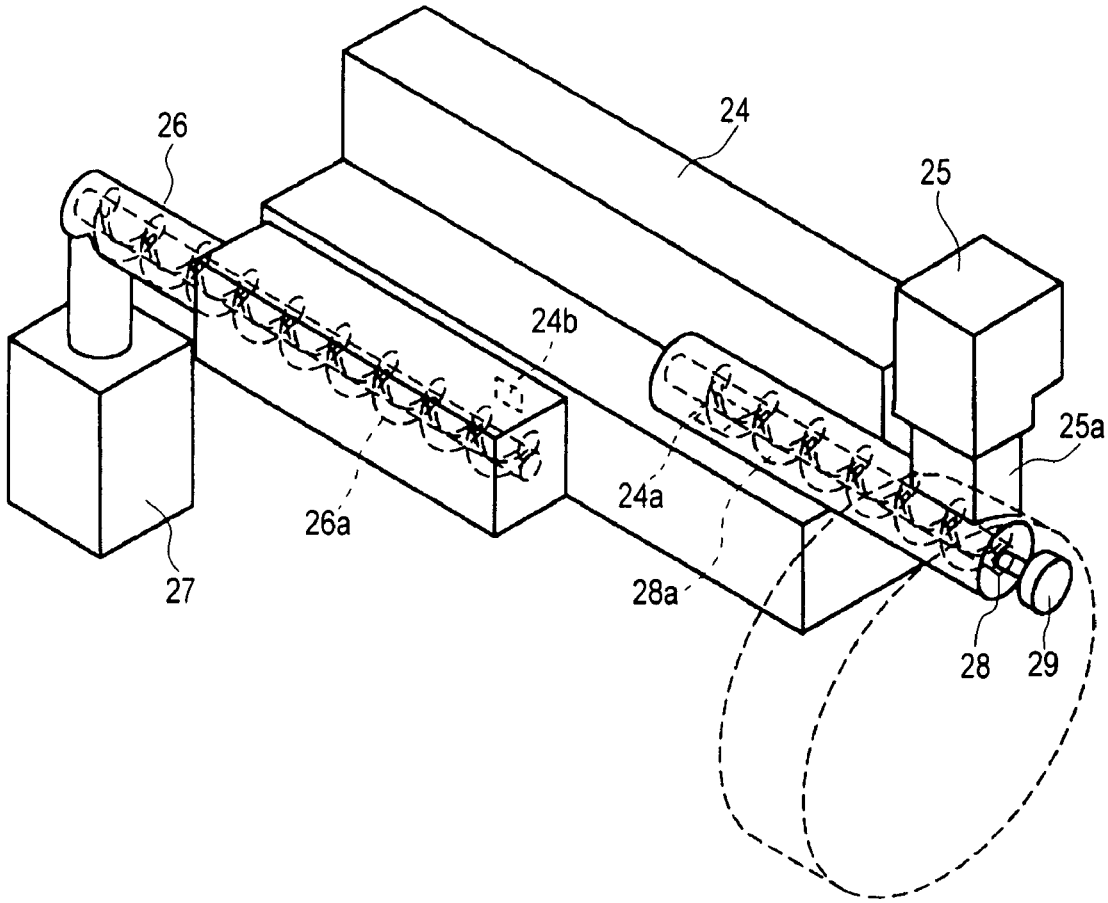
FIG. 2 is a schematic perspective view of one of the combinations of the developing apparatus, replenishing means, and discharging means, in accordance with the present invention.

The developing apparatus 3 employs the contact magnetic brush developing method and two-component developer, which essentially is a mixture of toner and carrier. Basically, the developing apparatus 3 comprises: a housing 24; a development sleeve 30 as a developer bearing member; a stirring/conveying screw 32 as a stirring/conveying member; and a stirring/conveying screw 33 as a stirring/conveying member, which is greater in the distance from the development sleeve 30 than the stirring/conveying screw 32. Above the stirring/conveying screw 33, a developer replenishing means comprising a hopper 25*a* is disposed, being integrally attached to the developing apparatus 3. To the hopper 25*a*, replenishment developer is supplied from a toner bottle 25, shown in FIG. 2, which will be described later in detail.

The development sleeve 30 has a stationary magnetic roll (unshown), which is disposed inside the hollow of the development sleeve 30, being solidly fixed to container. The magnetic roll has multiple magnetic poles. The development sleeve 30 is an electrically conductive cylinder, and is rotatably supported by a shaft so that the axial line of the magnetic roll coincides with the rotational axis of the development sleeve 30. The developer, that is, a mixture of toner and carrier, stored in the housing 24 is conveyed by the rotation of the electrically conductive cylinder, or the development sleeve 30. In this embodiment, the diameter of the photosensitive drum 2 is 84 mm, whereas that of the electrical conductive cylinder is 20 mm.

The developer in the housing 24 is magnetically held to the development sleeve 30 by the magnetic poles (unshown) of the magnetic roll in the development sleeve 30, and is conveyed by the rotation of the electrically conductive cylinder of the development sleeve 30, past a developer layer thickness regulating member 31, while being formed into a uniform developer layer with a predetermined thickness. The developer layer thickness regulating member 31 may be formed of either a nonmagnetic substance or a magnetic substance. However, those formed of magnetic substance are preferable, because the presence of magnetism ensures that the developer layer is reliably regulated.

After being coated on the peripheral surface of the development sleeve 30 and being formed into the uniform developer layer, the developer is conveyed by the rotation of the development sleeve 30 to the so-called development portion, which is where the distance between the peripheral surfaces of the development sleeve 30 and photosensitive drum 2 is smallest. In the development portion, the developer on the peripheral surface of the development sleeve 30 is made to crest in the form of a brush (magnetic brush) by one of the magnetic poles of the magnetic roll in the development sleeve 30, contacting thereby the peripheral surface of the photosensitive drum 2. Thus, the toner in the magnetic brush is adhered to the peripheral surface of the photosensitive drum 2 in the pattern of the latent image, by the difference in potential level between the DC voltage applied to the development sleeve 30, in combination with the AC voltage. In this embodiment, the gap between the peripheral surfaces of the development sleeve 30 and photosensitive drum 2 in the development portion is set to 400 μm. Also in this embodiment, the development sleeve 30 and photosensitive drum 2 are driven so that the peripheral surfaces of the development sleeve 30 and photosensitive drum 2 move in the same direction in the development portion, that is, the nip between the development sleeve 30 and peripheral surface 2, during the development.

In this embodiment, the light and dark portion potential levels of the photosensitive drum 2 are −200 V and −600 V, respectively. As for the potential level of the DC voltage applied to the development sleeve 30, it is −450 V. However, the optimal values for these voltages vary depending on toner color, ambience, and cumulative length of usage. Therefore, these voltages may be adjusted in potential level so that images with optimal (most preferable) density and gradation will be yielded. As for the properties of the AC bias applied to the development sleeve 30 in this embodiment, Vpp is 2,000 V, and FRQ is 2,000 Hz. Further, the waveform of the AC voltage does not need to be limited to the waveform in this embodiment.

The developer remaining on the portion of the peripheral surface of the photosensitive drum 2 having been just been used for development is further conveyed by the rotation of the development sleeve 30 into the housing 24, in which it is stripped from the peripheral surface of the development sleeve 30 by the repulsive magnetic field (magnetic field created by two magnetic poles of the same polarity disposed next to each other) generated by the magnetic roll in the development sleeve 30, falling onto the stirring/conveying screw 32, which is the stirring/conveying screw closer to the development sleeve 30.

The screw 32 is made up of a shaft, and a spiral blade coaxially attached to the shaft. As the screw 32 is rotated, the developer is conveyed in the predetermined direction while being stirred. As the developer is conveyed by the screw 32 to one of the lengthwise ends of the housing 24 in terms of the developer conveyance direction, it is moved into the chamber in which the stirring/conveying screw 33 is disposed, which is identical in structure to the screw 32, but, opposite in the developer conveyance direction from the screw 32.

Onto the stirring/conveying screw 33, developer smaller in the amount of carrier than the developer in the developing apparatus 3 is allowed to fall, and is conveyed by the screw 33 while being stirred, being thereby mixed with the developer in the developing apparatus 3. Then, the mixture is passed to the screw 32, by which it is supplied to the development sleeve 30.

In the developing apparatus 3, developer replacement occurs. More specifically, the image forming apparatus 1 is provided with the replenishing means for supplying the developing apparatus 3 with the replenishment developer, that is, developer smaller in the amount of carrier than the developer in the developing apparatus. It is also provided with a discharging means that discharges the developer in the developing apparatus 3 from the developing apparatus, as the developing apparatus 3 is replenished with the replenishment developer. Next, referring to FIG. 2, this process of gradually replacing the developer in the developing apparatus 3 with the replenishment developer will be described.

The developing apparatus 3 employs the contact magnetic brush developing method, and the two-component developer, which essentially is a mixture of toner and carrier. In order to automatically and gradually replace the developer in the developing apparatus 3 with a fresh supply of the replenishment developer, the fresh supply of replenishment developer is tricked into the developing apparatus 3 while discharging the developer in the developing apparatus 3 by the amount equal to the amount by which the replenishment developer is trickled into the developing apparatus 3. More specifically, the replenishment developer is trickled into the developing apparatus 3 so that the toner content in the developer in the developing apparatus 3 remains in a range of 7–7 wt. %. The amount by which the replenishment developer is to be trickled into the developing apparatus 3 is to be adjusted according to the amount of the toner charge, particle diameter of the carrier, structure of the image forming apparatus, and/or the like factors. In other words, the amount does not need to be set to a value in the above-mentioned range.

The developing apparatus 3 comprises: the housing 24 in which a latent image on the photosensitive drum 2 is developed while the two-component developer is circulated therein, as described above; developer replenishing means which replenishes the developing apparatus 3 with the replenishment developer from the toner bottom 25, that is, the replenishment developer container in which the replenishment developer is stored, which essentially is a mixture of a fresh supply of toner and a small amount of fresh supply of carrier; and a discharging means which recovers the deteriorated developer into a developer recovery bin 27.

The housing 24 has a developer inlet 24*a* and a developer outlet 24*b*.

The developer inset 24*a* comprises: a developer conveyance path 28 through which the mixture of toner and carrier stored in the toner bottle 25 is conveyed to the developing apparatus 3; the hopper 25*a* disposed between the toner bottle 25 and developer conveyance path 28; and a replenishment screw 28*a* as a developer conveying member disposed in the developer conveyance path 28. The replenishment screw 28*a* is rotated by a developing device driving motor through a clutch. To the upstream end of the replenishment screw 28*a* in terms of the developer conveyance direction, an encoder 29 is integrally attached, which is for detecting the revolutions of the replenishment screw 28*a*.

To the developer outlet 24*b*, a discharge pipe 26 as a developer discharging means is connected, which is for discharging the deteriorated developer. In the discharge pipe 26, a screw 26*a* is disposed, which discharges the deteriorated developer into the developer recovery bin 27. To the bottom end of the discharge pipe 26, the developer recovery bin 27 is removably connectible.

In the housing 24, the development sleeve 30 as a developer bearing member, developer layer thickness regulating member 31, screw 32, and screw 33 are disposed. As described before with reference to FIG. 1, the development sleeve 30 is a developer bearing member, which is disposed in a manner of opposing the photosensitive drum 2. It conveys the developer in the housing 24 to the peripheral surface of the photosensitive drum 2. The developer layer thickness regulating member 31 is formed of nonmagnetic substance, and is disposed a predetermined distance from the peripheral surface of the development sleeve 30 to regulate in thickness the layer of developer borne on the peripheral surface of the development sleeve 30. The screw 32 is for supplying the peripheral surface of the development sleeve 30 with the developer while stirring the developer, and screw 33 is for conveying the developer while stirring it.

The internal space of the housing 24 has an upstream chamber and a downstream chamber, in terms of the developer conveyance direction, partitioned by a partition wall 24*c*. The screws 32 and 33 are disposed in the upstream and downstream chambers, respectively, partitioned by the partition wall 24*c*. The lengthwise ends of the partition wall 24*c* do not extend to the corresponding internal surfaces of the housing 24. Thus, there is a passage between one of the lengthwise ends of the partition wall 24*c* of the housing 24 and the corresponding internal surface, and there is another passage between the other lengthwise end of the partition wall 24*c* and the corresponding internal surface of the housing 24. In other words, the upstream and downstream chambers of the housing 24 are connected through these two passages.

As the developer in the housing 24 is increased in volume by the replenishment of a fresh supply of developer from the toner bottle 25, the developer in the housing 24 overflows through the developer outlet 24*b*; the fresh supply of replenishment developer is trickled into the housing 24 and the deteriorated developer in the housing 24 is trickled out of the housing 24.

The timing with which the housing 24 is supplied with the replenishment developer will not be described in detail. However, generally, the operation for supplying the housing 24 with the replenishment developer is controlled in response to the video count value stored in an unshown controller, video count value obtained based on the length of time the laser embedded in the controller substrate of the printer (main assembly of copying machine) is kept on, as well as the image density data obtained by detecting the density level of the density level detection patches formed on the sheet P or the intermediary transferring member 5*a*.

As the developer in the housing 24 increases in volume due to the fresh supply of replenishment developer supplied into the housing 24 from the toner bottle 25, the developer in the housing 24 overflows through the developer outlet 24*b*. As a result, the carrier in the housing 24 is automatically refreshed (ACR).

As for the positional relationship among the developer inlet 24*a* and developer outlet 24*b* of the housing 24, and the components disposed in the housing 24, in terms of the direction in which the developer is conveyed by the screws 32 and 33, the area in which the development sleeve 30 is supplied with the replenishment developer is the most upstream one, listing from the upstream side, and then, the developer outlet 24 and developer inlet 24*a* are disposed in the listed order. The developer inlet 24*a* and developer outlet 34*b* are disposed away from each other.

The toner bottle 25 is structured so that it can be removably attached to the main assembly of an image forming apparatus, being enabled to be replaced with a brand-new toner bottle (25) as the developer in the toner bottle 25 is depleted of the replenishment developer.

In the case of the above described structural arrangement, that is, the structural arrangement in which the replenishment developer containing a small amount of carrier is trickled into the developing apparatus 3 and the deteriorated developer in the developing apparatus 3 is trickled out of the developing apparatus 3. In other words, the developing apparatus 3 in this embodiment is structured so that the deteriorated carrier in the housing 24 is gradually replaced with a fresh supply of carrier. Thus, the employment of this structural arrangement is effective to extend the service life of the developer in the developing apparatus 3; it makes it possible to rejuvenate the developer, that is, the developer the carrier of which has deteriorated due to usage. Without the employment of the above described structural arrangement, the external additives of the developer gradually accumulate on the surfaces of the carrier (toner-spent phenomenon), causing the carrier to reduce in the ability to electrically charge the toner particles, resulting therefore in such problems as the formation of an image of inferior quality (for example, an image suffering from fog), scattering of toner, and the like, which are attributable to insufficient charging of toner. In other words, as long as the deteriorated developer is gradually replaced with the replenishment developer, the occurrences of the so-called toner-spent phenomenon can be minimized, and therefore, the developer in the housing 24 lasts longer.

This structural arrangement can be characterized in that the greater the amount of the carrier in the replenishment developer stored in the toner bottle 25, the faster the carrier in the developer in the housing 24 is replaced, and therefore, the smaller the average amount by which the developer is "spent" in the housing 24. It is also characterized in that the greater the image ratio, the faster the carrier in the developer in the housing 24 is replaced. In other words, the greater the carrier ratio in the replenishment developer, and the higher the image ratio of an image to be formed, the more meritorious this structural arrangement. However, the main purpose of supplying the developing apparatus 3 with the replenishment developer is to supply the developing apparatus 3 with toner. Therefore, the upper limit of the carrier ratio in the replenishment developer is 40 wt. % in consideration of the fact that the housing 24 has to be supplied with a sufficient amount of toner.

It has been a common practice to use a toner which contains carbon black and is relatively high in resistivity, as the black toner for the black developer used when forming a black image with the use of a color image forming apparatus described above. However, the usage of such a black toner is problematic in that during the early stage of an image forming operation, image quality of a predetermined level can be achieved, but, the achievable-level of image quality gradually declines with the increase as the image forming operation continues.

Thus, in this embodiment, the "toner-spent" phenomenon is reduced by gradually replacing the developer in the developing apparatus by virtually continuously supplying the developing apparatus with a small amount of carrier and virtually continuously discharging the developer in the developing apparatus, with the employment of the above described structural arrangement. Further, the composition of the developer to be stored in the developing apparatus 3 is adjusted, as follows, depending on whether the developer is stored in the black developing apparatus used for the formation of a black image, or in one of the color developing apparatuses used for forming a monochromatic color image. Moreover, the replenishment developer to be stored in the toner bottle 25 is adjusted in carrier ratio, as will be described later in more detail, to ensure that the color image forming apparatus will continuously yield black images of high quality.

First, the preferable developers to be used with the developing apparatuses in this embodiment will be described.

Each of the four developers in this embodiment is essentially a mixture of magnetic carrier, and nonmagnetic pigment-based toner. The four developers are different in the color of the pigment. The magnetic carrier and nonmagnetic toner are mixed so that the the resultant developer becomes 7 wt. % in initial toner density.

As for the material for the magnetic carrier for the developer, one of the ferrites made of one of metallic substances, for example, superficially oxidized particulate iron, non-oxidized iron, nickel, cobalt, manganese, rare-earth metals chrome, etc., or one of the ferrites made of one of the oxides of the abovementioned metallic substances. There is no restriction regarding the method for producing the magnetic carrier. The magnetic carrier particles may be coated with resin with the use of one of the known methods. Also in this embodiment, particulate ferrite containing neodymium, samarium, barium, or the like, and coated with resin, is used as carrier. As for the weight average particle diameter of the carrier, it is desired to be in the range of 20–100 μm, preferably, 20–70 μm. As for the volume resistivity (specific resistance) of the carrier, the volume resistivity of the carrier for the color developer is desired to be in the range of $10^7$–$10^9$ Ω·cm, and that for the black developer is desired to be in the range of $10^9$–$10^{10}$ Ω·m.

The specific resistance of the magnetic carrier was measured with the use of the following method: A cell is filled with the magnetic carrier, and a pair of electrodes were disposed so that one of the electrodes contacts one end of the cell, and the other electrode contacts the other end of the cell. Then, the amount of the current which flowed through the cell was measured while applying voltage between the pair of electrodes. As for the conditions under which the specific resistance was measured, the size of the contact area between the electrode and the carrier in the cell was roughly 2.3 $cm^2$, and the thickness of the body of carrier in the cell was roughly 2 mm. The amount of the weight applied to the top electrode was 180 g, and the amount of voltage applied between the two electrodes was 100 V. Since the magnetic carrier is powdery, there is the possibility that the developer in the cell will change in fill factor. The change in the fill factor of the developer in the cell results in the change in the specific resistance of the developer in the cell. Therefore, in order to prevent the changes in the specific resistance of the developer in the cell, special attention must be paid when filling the cell with the developer.

Also regarding the electrical resistance of the carrier, if it is no more than $1.0\times10^7$ Ω·cm, that is, if it too low, it is too easy for electrical charge to be injected into the carrier, causing therefore carrier adhesion. Therefore, this value is the smallest value acceptable as the value for the electrical resistance of the carrier. If it is no less than $1.0\times10^{10}$ Ω·cm, toner particles are made by the body of developer surrounding the toner particles, to act as if they were electrically nonconductive. If the toner particles act as if they were electrically nonconductive, the image forming apparatus is likely to yield defective images attributable unsatisfactory development, for example, an image suffering from edge exaggerations, or the like. Therefore, $1.0\times10^{10}$ Ω·cm is the top limit of the electrical resistance of the carrier.

The average particle diameter of the magnetic carrier is represented by the maximum vertical chord length. In this embodiment, the carrier particles were photographed with the use of a microscope, with its power set to a value in the range of 50–1,000. Then, no less than 3,000 carrier particles in the carrier photograph were randomly selected, and they were actually measured in maximum chord length. Then, the average particle diameter of the carrier was obtained as the arithmetic average of the thus obtained maximum chord length values of the randomly selected carrier particles.

Regarding the amount of the carrier magnetization, the carrier, the magnetization amount of which is roughly $3.0\times10^5$ A/m, that is, the normal amount of magnetization of ferrite, is used. However, the amount of the carrier magnetization does not need to be limited to the above-mentioned value. However, it is desired to be in the range of $3.0\times10^4$ A/m–$3.0\times10^5$ A/m. A carrier which is no more than $3.0\times10^4$–$3.0\times10^5$ A/m in the amount of magnetization causes the problem that the development sleeve fails to be satisfactorily coated with the developer, or the like problem, whereas if a carrier which is no less than $3.0\times10^5$ A/m in the amount of magnetization, it is possible that the image forming apparatus will yield grainy images attributable to the nonuniformity in the texture of the magnetic brush. In this embodiment, therefore, a carrier which is in the above-mentioned range in terms of the amount of magnetization is used.

The amount of magnetization of carrier was calculated using the following method. That is, the carrier was packed in the magnetic field of 100 mT, and the amount of magnetization ($Am^2/kg$) of the carrier was measured with the use of an automatic magnetic property recording apparatus of the oscillatory magnetic filed type (product of Riken Electronic Co., Ltd.). Then, the obtained value was multiplied with the true specific gravity ($kg/m^3$) of the carrier, obtaining thereby the amount of magnetization of the carrier by calculation.

Regarding the selection of the toners compatible with the above-described magnetic carrier, one of the various known toners manufactured by pulverization, or the like toners, may be used.

The volume average particle diameter of the toner is desired to be in the range of 4–15 μm. The volume average particle diameter of the toner may be measured with the use of the measuring method described below, for example.

As the measuring apparatus, a Coulter Counter TA-I (product of Coulter Co., Ltd.) was used, to which an interface (product of Nikkaki Co., Ltd.) and a personal computer X-i (product of Canon) were connected. As the electrolyte, 1% water solution of NaCl was formulated using sodium chloride (first-class reagent).

To 100–150 ml of the above-described electrolyte, 0.1–5 ml of surfactant (preferably, alkyl-benezene-sulfonate) was added as dispersant. Then, to this mixture, 0.5–50 mg of the test sample of the toner was added so that the test sample was suspended in the mixture. This electrolyte in which the test sample of the toner was suspended was subjected to an ultrasonic dispersing device for roughly 1–3 minutes to uniformly disperse the test sample of the toner. Then, the distribution of the toner particles which were in the range of 2–40 μm in terms of particle diameter was obtained with the use of the above-mentioned Coulter Counter TA-I fitted with a 100 μm aperture. Then, the volume distribution of the toner was obtained. Then, the volume average particle diameter of the toner was obtained from the thus obtained volume distribution of the toner.

As for the particle diameter of the external additives to be added to the developer to be used with an image forming apparatus (developing apparatus) in accordance with the present invention, it is desired to be no more than 1/10 the weight average particle diameter of the toner, in consideration of their durability after their addition to the toner. Here, the particle diameter of the additive means the average particle diameter of the additive obtained by observing the surfaces of the toner particles with the use of a microscope. The ratio at which the external additives are added to the toner is desired to be 0.01–15, preferably, 0.05–12, parts in weight of the external additives relative to 100 parts in weight of the toner.

The following are the list of substances usable as the external additive: metallic oxides such as aluminum oxide, titanium oxide, strontium titanate, cerium oxide, magnesium oxide, chromium oxide, tin oxide, zinc oxide, etc.; nitride such as silicon nitride; carbide such as silicon carbide; metallic salts such as calcium sulphate, barium sulphate, calcium carbonate, etc.; metallic salts of fatty acid such as zinc stearate, calcium stearate, etc.; carbon black; silica; etc. These substances may be added alone or in combination. It is preferred that they are processed so that they become hydrophobic. Further, in consideration of the fact that not only are they required to play the role of providing the developer with fluidity, but also, to control the toner in terms of the amount of electrical charge, the polarity of the external additive is very important.

In this embodiment, to the toner which is negative in polarity, silica which is negative in polarity, and titanium oxide which is positive in polarity, are externally added at a ratio of 1.0%. Both substances are for improving the developer in fluidity. However, the silica is added also for improving the toner in the amount of electrical charge it holds.

The polarity to which the toner, inclusive of the above-mentioned ingredients, becomes charged may be negative or positive. In this embodiment, however, the toner which is inherently chargeable to the negative polarity is used. The average amount of electrical charge (amount of electrical charge per unit weight of toner, which hereinafter will be referred to as Q/M) which the toner used in this embodiment acquires due to the friction between the toner and carrier is in the range of $-1.0\times10^{-2}$ C/kg–$-6.0\times10^{-2}$ C/kg.

To summarize the various descriptions about the color and black developers used in this embodiment, it can be concluded that a mixture of the magnetic carrier having the following characteristics (A1), (A2), and (A3), and one of the known toners, formulated so that the toner density of the mixture becomes 7–8 wt. % is the preferable developer.

(A1) Specific Resistance: $10^7$–$10^9$ Ω·cm for color developers; and $10^9$–$10^{10}$ Ω·cm for black developer.

(A2) Weight Average Particle Diameter: 20–100 μm, preferably, 20–70 μm, for both color and black developers.

(A3) Magnetization Amount: $3.0\times10^4$ A/ml–$3.0\times10^5$ A/m.

As has been described thus far, in this embodiment, the black developer used by the developing apparatus 3 contains a magnetic carrier which is higher in specific resistance than the magnetic carrier for the color developers, and further, the developing apparatus 3 employs the ACR structure; it is structured so that the developer in the developing apparatus 3 is automatically discharged at the same time the developing apparatus is supplied with the replenishment developer. As for the carrier ratio of the developer, it is rendered greater in the developer used with the black developing apparatus than each of the developers used with the color developing apparatuses. As for the types of the magnetic carrier and toner contained in the replenishment developer, they are basically the same as those initially stored in the developing apparatuses 3.

The following are the results of the following durability Test 1, and Comparative durability Tests, carried out using the developing apparatuses 3 described above in order to obtain the optimal weight ratio (wt. %) for the carrier for the replenishment developers (replenishment black developer and color replenishment toners) with which the black and color developing apparatuses are replenished, and optimal specific resistance for the magnetic carrier to be mixed with the toner to formulate the developers to be placed in the developing apparatuses 3.

Durability Test 1

Various developers different in the specific resistance of the carrier and carrier ratio were subjected to the durability tests which were carried out with the use of the developing apparatuses 3 in accordance with the present invention. Durability Test 1, Comparative Durability Test 1, and Comparative Durability Test 2 are differentiated in the specific resistance of the magnetic carrier contained in the developers in the developing apparatuses 3, and the carrier ratio in the replenishment developer. In each test, 100K copies were formed, and the copies formed during the initial period of the image forming operation, and the 100K-th copy were evaluated in the amount of toner charge, severity of fog, amount of the scattering of toner, and graininess.

The severity of fog was evaluated by measuring fog reflectance, and the amount of the scattering of toner was evaluated by measuring the amount of the contamination of the grid of the primary charging device. In the following evaluations, G stands for "good"; F stands for "defects are present, but, do not affect image quality"; and NG stands for "no good (affects image quality)". As for the image quality, the graininess was evaluated in three grades (G, F, and NG). As for the evaluation of fog, if a copy is no more than 2.0% in fog reflectance, it was evaluated as "OK". As for the evaluation of the scattering of toner, and graininess, if a copy is above the F level, it was evaluated as "OK". The amount of toner charge was measured with the use of the ordinary two-component blow-off method. In the tests, the black toner for the black developer, and the cyan toner for one of the color developers, were evaluated and compared.

Durability Test 1 (Embodiment 1)

Durability Test Conditions:
Image ratio: 10%
Number of recording mediums: 100K
Specific resistance of carrier for black developer: $1.0\times10^{10}$ (Ω·cm)
Specific resistance of carrier for color developer: $1.0\times10^{8}$ (Ω·cm)
Carrier ratio of replenishment black developer: 15 (wt. %)
Carrier ratio of replenishment color developer: 5 (wt. %)
Results:
During Initial Period
Black toner
amount of toner charge: −24 μC/g
fog reflectance: 1.0%
toner scattering: G
graininess level: G
Cyan toner
amount of toner charge: −27 μC/g
fog reflectance: 0.9%
toner scattering: G
graininess level: G
100K-th Copy
Black toner
amount of toner charge: −20 μC/g
fog reflectance: 1.7%
toner scattering: F
graininess level: F
Cyan toner
amount of toner charge: −23 μC/g
fog reflectance: 1.5%
toner scattering: F
graininess level: F As will be evident from the results given above, with the specific resistance of the carrier of the black developer set higher than those of the carrier of the color developer, and also, the carrier ratio of the replenishment black developer set higher than those of the replenishment color developers, the amount of the toner charge and image quality remained stable not only during the initial period of the durability tests, but also, throughout the durability tests.

More specifically, the image forming apparatus (developing apparatus 3) can be improved and stabilized in terms of the quality of a black image, by using, as the carrier for the black developer, such a carrier that is no less than $1.0\times10^{9}$ and no more than $1.0\times10^{10}$ in specific resistance, and using, as the carrier for the color developers, such a carrier that is no less than $1.0\times10^{7}$ and no more than $1.0\times10^{9}$ in carrier ratio, as in the following comparative tests, and moreover, keeping the carrier ratio of the replenishment black developer, and the carrier ratio of each of the replenishment color developers, in ranges of 10–40 wt. %, and 1–15 wt. %, respectively.

Comparative Durability Test 1

Test Conditions:
Image ratio: 10%
Number of recording mediums: 100K
Specific resistance of carrier for black developer: $1.0\times10^{8}$ (Ω·cm)
Specific resistance of carrier for color developer: $1.0\times10^{8}$ (Ω·cm)
Carrier ratio of replenishment black developer: 15 (wt. %)
Carrier ratio of replenishment color developer: 5 (wt. %)
Results:
During Initial Period
Black toner
amount of toner charge: −18 μC/g
fog reflectance: 2.3%
toner scattering: NG
graininess level: NG
Cyan toner
amount of toner charge: −27 μC/g
fog reflectance: 0.9%
toner scattering: G
graininess level: G
100K-th Copy
Black toner
amount of toner charge: −14 μC/g
fog reflectance: 3.3%
toner scattering: NG
graininess level: NG
Cyan toner
amount of toner charge: −23 μC/g
fog reflectance: 1.5%
toner scattering: F
graininess level: F In Comparative Durability Test 1, the black developer was made to be the same in the specific resistance of the carrier as the color developers, and other conditions were kept the same as those in the Durability Test 1. The results were, as follows: not only did the black toner yield images suffering from fog, but also, the black toner scattered, from the beginning of the durability test. Further, even the images yielded during the beginning of the test were below the acceptable level in terms of image quality.

Comparative Durability Test 2

Test Conditions:
Image ratio: 10%
Number of recording mediums: 100K
Specific resistance of carrier for black developer: $1.0\times10^{10}$ (Ω·cm)
Specific resistance of carrier for color developer: $1.0\times10^{8}$ (Ω·cm)
Carrier ratio of replenishment black developer: 5 (wt. %)
Carrier ratio of replenishment color developer: 5 (wt. %)
Results:

During Initial Period
Black toner
amount of toner charge: −24 μC/g
fog reflectance: 1.0%
toner scattering: G
graininess level: G
Cyan toner
amount of toner charge: −27 μC/g
fog reflectance: 0.9%
toner scattering: G
graininess level: G
100K-th Copy
Black toner
amount of toner charge: −12 μC/g
fog reflectance: 4.0%
toner scattering: NG
graininess level: NG
Cyan toner
amount of toner charge: −23 μC/g
fog reflectance: 1.5%
toner scattering: F
graininess level: F In Comparative Durability Test 2, the black replenishment developer was rendered the same in carrier ratio as the replenishment color developer unlike in Test 1. The results were, as follows: during the initial period of the duration test, the black toner yielded satisfactory images. However, at the 100K-th copy, the black developer yielded an image suffering from fog, and also, the toner scattered. Further, the 100K-th image was below the acceptable level in terms of quality. In other words, the comparative black developer failed to continuously yield high quality images except for the initial period.

It became evident from the results of Durability Test 1 that by making the carrier for the developer for black image formation higher in specific resistance than the carrier for the developer for color image formation, and further, making the replenishment developer for black image formation higher in carrier ratio than the replenishment developer for color image formation, not only did the image forming apparatus continuously yield high quality images (fog-free images), for a long time, but also, high quality color images (fog-free images) for a long time. Further, neither the black nor color toners scattered.

It also became evident from the results of Durability Test 1 that the specific resistance of the carrier for the black developer was desired to be no less than $1.0\times10^{9}$ and no more than $1.0\times10^{10}$, and the specific resistance of each of the color developers was desired to be no less than $1.0\times10^{7}$ and no more than $1.0\times10^{9}$, and also, that the carrier ratio of the replenishment black developer was desired to be in the range of 10–40 wt. %, and the carrier ratio of the replenishment color developer was desired to be lower than that for the replenishment black developer, being in the range of 1–15 wt. %.

As described above, by employing the automatic developer replacement system structured so that developing apparatuses are gradually supplied with replenishment developer, and the developers in the developing apparatuses are gradually discharged, while formulating the replenishment developers so that the replenishment black developer is rendered higher in magnetic carrier ratio than each of the replenishment color developers, to prevent the "toner-spent" phenomenon, and also, so that the replenishment developer for black image formation is rendered higher in carrier ratio than the replenishment developers for color image formation, it is possible to realize an image forming apparatus capable of yielding high quality images for a long time.

The structure of the image forming apparatus shown in FIG. 3 is not intended to limit the scope of the present invention. In other words, not only is the present invention compatible with the image forming apparatus shown in FIG. 3, but also, an electrostatic image forming apparatus. Further, regarding the transferring method, not only is the present invention compatible with the above-described image forming apparatus employing the intermediary transferring member, but also, an image forming apparatus of the direct transfer type, which does not employ an intermediary transferring member, and in which toner images are directly transferred from image bearing members onto recording medium. Further, in terms of the number of image bearing members, not only is the present invention compatible with the above-described image forming apparatus employing only a single image bearing member, but also, an image forming apparatus of the tandem type, which employs a plurality of image bearing members, one for each color component.

Further, the number and types of the color developers do not need to be limited to the above-described ones.

The measurements, materials, and shapes of the structural components of the image forming apparatus, their positional relationships, etc., in the above-described embodiment of the present invention are not intended to limit the scope of the present invention unless specified noted.

Embodiment 2

This embodiment is different in the structure of the developing apparatus from the first embodiment. More specifically, the developing apparatus in this embodiment is provided with a plurality (two) of development sleeves. Otherwise, the developing apparatus in this embodiment is the same in structure as that in the first embodiment. In the first embodiment, the present invention was described with reference to the image forming apparatus comprising the single photosensitive drum 2, and rotary development system having four developing apparatuses 3 different in color of the developers they use. The structural arrangement for a developing device, in this embodiment, is suitable for an image forming apparatus of the tandem type, in which four photosensitive drums are disposed in tandem to increase the apparatus in image formation speed, although it is also applicable to an image forming apparatus, such as the one shown in FIG. 3, employing the rotary development system.

Next, referring to FIGS. 4 and 5, the general structure of the developing device in this embodiment will be described. FIG. 5 is a schematic perspective view of the developing apparatus as seen from a point diagonally above one of the top rear corners of the apparatus. The arrow marks in FIG. 5 indicate the direction in which the developer is conveyed, except for the directions in which the developer is conveyed (moved) by the stirring/conveying screws 43 and 44 in the top and bottom chambers 40 and 41, respectively.

In the hollow of a development sleeve 51*a* rotatably disposed upstream of a development roller 51*b* in terms of the moving direction of the peripheral surface of a photosensitive drum 2, a magnetic roll 52*a* is stationarily disposed, which has a plurality of magnetic poles. As the development sleeve 51*a* is rotated, the developer is borne on the peripheral surface of the development sleeve 51*a*, and is conveyed by the movement of the peripheral surface of the development sleeve 51*a* while being retained on the peripheral surface of the development sleeve 51*a*, forming a magnetic brush on the peripheral surface of the development sleeve 51*a*, by the magnetic force from the magnetic poles of the magnetic roll 52*a*. As the body of developer on the peripheral surface of the development sleeve 51*a* is moved past a developer layer thickness regulating member 45, it is regulated in the amount of developer per unit area of the peripheral surface of the development sleeve 51*a*. The magnetic roll 52*a* is positioned so that its magnetic pole S2 roughly opposes the photosensitive drum 2, in the area in which development occurs. Thus, the magnetic brush formed on the peripheral surface of the photosensitive drum 2, on the area corresponding in position to the magnetic pole S2 (development pole) contacts the peripheral surface of the photosensitive drum 2, allowing the toner in the magnetic brush to be adhered to the peripheral surface of the photosensitive drum 2 by the electric field formed between the development sleeve 51*a* and photosensitive drum 2; in other words, the latent image on the peripheral surface of the photosensitive drum 2 is developed.

The portion of the developer layer, on the peripheral surface of the first development sleeve 51*a*, which has just been used for development, is further conveyed by the first development sleeve 51*a*, and then, is transferred, in the area in which the distance between the first development sleeve 51*a*, and the second development sleeve 51*b* disposed downstream of the first development sleeve 51*a*, in terms of the moving direction of the peripheral surface of the photosensitive drum 2, onto the second development sleeve 51*b*. The second development sleeve 51*b* is basically the same in structure the first development sleeve 51*a*. In other words, it is an electrically conductive rotatable cylinder, and contains a stationary magnetic roll 52*b* in its hollow. As for the transfer of the developer from the first development sleeve 51*a* onto the second development sleeve 51*b*, the developer on the first development sleeve 51*a* is transferred to the development sleeve 51*b* by the magnetic pole N3 (developer passing pole) of the first magnetic roll 52*a*, onto the portion which coincides in position with the magnetic pole S3 (receiving pole) of the second magnetic roll 52*b* in the second development sleeve 51*b*, and is adhered to the peripheral surface of the development sleeve 51*b* by the magnetic force from the magnetic pole S3. The magnetic pole S3 (receiving pole) is opposite in polarity to the magnetic pole N3 (passing pole), causing the developer to smoothly transfer from the development sleeve 51*a* onto the development sleeve 51*b*.

The developer having been passed onto the second development sleeve 51*b* is conveyed by the rotation of the second development sleeve 51*b*, to the area which corresponds in position to the magnetic pole N4 (development pole) of the magnetic roll 52*b* in the second development sleeve 51*b*, and in which the developer is made to form a magnetic brush, from which the toner therein is adhered to the peripheral surface of the photosensitive drum 2 as was the toner in the magnetic brush formed by the magnetic pole S2 (development pole) of the first magnetic roller 52*a* in the development sleeve 51*a*. The portion of the development layer on the peripheral surface of the second development sleeve 51*b*, from which the toner was adhered to the peripheral surface of the photosensitive drum 2, is further conveyed by the rotation of the second development sleeve 51*b* into the developer recovery chamber 41 of the developing apparatus, in which it is repelled from the peripheral surface of the second development sleeve 51*b* by the repulsive magnetic field generated by the magnetic poles S4 and S3 of the second magnetic roll 52*b*, and falls down in the developer recovery chamber 41.

After falling down in the developer recovery chamber 41, the repelled developer is conveyed in a predetermined direction by the stirring/conveying screw 44 in the developer recovery chamber 41. As it reaches the end of the developer recovery chamber 41, in terms of the developer conveyance direction, it is forced to move roughly upward of the developer recovery chamber 41, because there is no direction in which the developer is allowed to move except upward. Thus, the developer is moved upward into the developer supply chamber 40 located roughly on top of the developer recovery chamber 41, through the opening 49 of the partition wall 46 between the developer recovery chamber 41 and developer supply chamber 40. After being lifted into the developer supply chamber 40, the developer is conveyed by the stirring/conveying screw 43 in the developer supply chamber 40 while being supplied to the first development sleeve 51*a*.

The excess portion of the developer in the developer supply chamber 40, that is, the portion which was not supplied to the first development sleeve 51*a* in the developer supply chamber 40, is conveyed to the end of the developer supply chamber 40 in terms of the developer conveyance direction, at which point it falls into the developer recovery chamber 41 through the opening (unshown) of the partition wall 46 between the developer recovery chamber 41 and developer supply chamber 40. It should be noted here that the developer supply chamber 40 extends beyond the range of the development sleeve 51*a* which is coated with the developer, at both ends.

Figure 4:
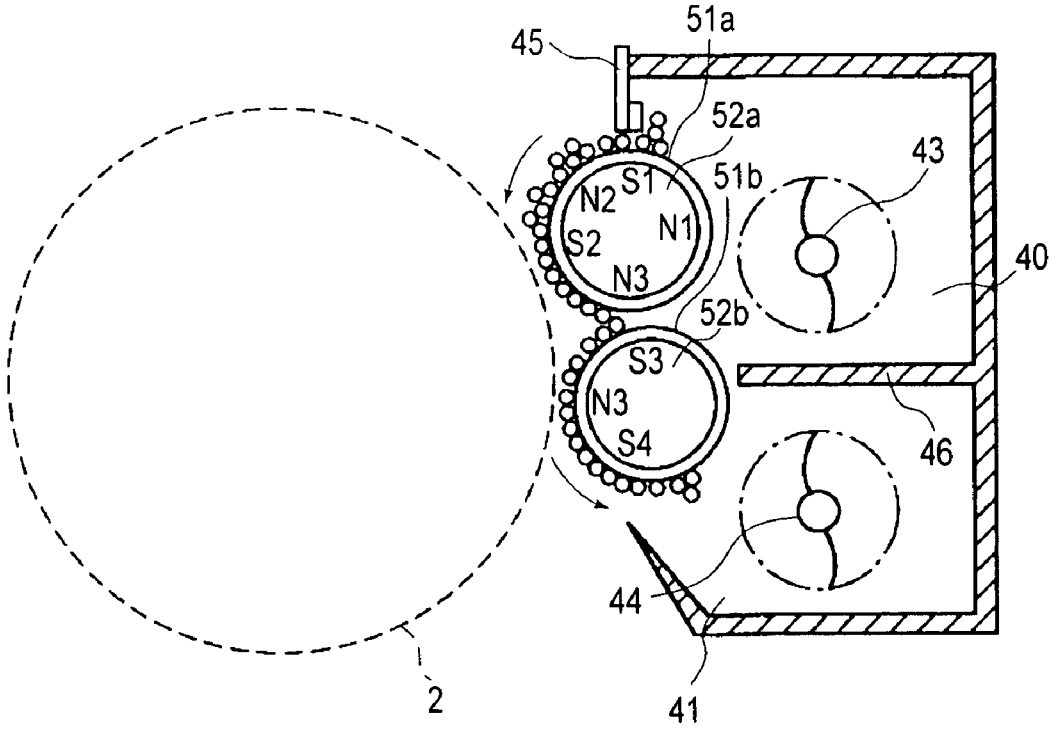
FIG. 4 is a sectional view of another developing apparatus in accordance with the present invention.
Figure 5:
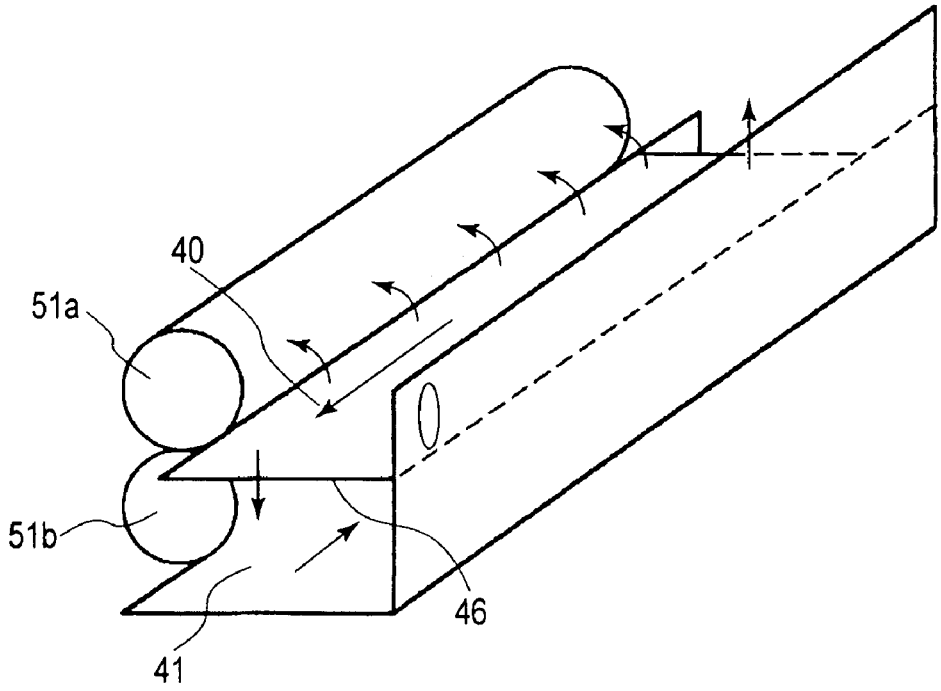
FIG. 5 is a sectional view of another developing apparatus in accordance with the present invention.

Although not shown in shown in FIGS. 4 and 5, the developing apparatus in this embodiment also is provided with a replenishment developer supplying means for supplying the developing apparatus with the replenishment developer, and a discharging means for discharging the developer from the developing apparatus. These two means are similar to those of the developing apparatus in the first embodiment. Thus, the developer in the developing apparatus is automatically replaced as in the first embodiment.

The developing apparatus in this embodiment is provided with two development sleeves, being superior in development performance, that is, being capable of thoroughly developing a latent image. Here, development performance means the efficiency level at which the potential level of the top (outer surface) of the toner (developer) layer on a development sleeve becomes the same as the potential level of the peripheral surface of the development sleeve as toner is adhered to the latent image, in the development portion.

With the employment of the above-described structural arrangement for a developing apparatus, it is possible to ensure a high level of development performance even when a carrier with a relatively high electrical resistance is used. Compared to the structural arrangement for a developing apparatus which employs only one development sleeve, in terms of the unsatisfactory development and overemphasizing of edges, the structural arrangement of a developing apparatus in this embodiment makes it possible to employ a carrier which is much higher in electrical resistance. More specifically, the structural arrangement for a developing apparatus in this embodiment can raise the upper limit of the carrier resistance value to the adjacencies of $1.0\times10^{12}$.

In FIGS. 4 and 5, the developer supply chamber in which the developer is supplied to the development sleeves is positioned on the developer recovery chamber. However, it may be positioned under the developer recovery chamber in order to reduce the pressure applied to the developer by the magnetic pole for regulating the thickness of the developer layer, because such a modification does not affect the effectiveness of this embodiment.

The developing apparatus and developers in this embodiment were subjected to Durability Test 2 similar to the above described Durability Test 1 in order to confirm the effectiveness of this embodiment. The following are the results of Durability Test 2.

Durability Test 2

In this embodiment, a carrier which is $1.0\times10^{12}$ in specific resistance was used as the carrier for formulating the black developer, and the carrier ratio of the replenishment black developer was set to 15 wt. %.

Developers in Embodiment 2

Test Conditions:
Image ratio: 10%
Number of recording mediums: 100K
Specific resistance of carrier for black developer: $1.0\times10^{12}$ (Ω·cm)
Specific resistance of carrier for color developer: $1.0\times10^{8}$ (Ω·cm)
Carrier ratio of replenishment black developer: 15 (wt. %)
Carrier ratio of replenishment color developer: 5 (wt. %)
Results:
During Initial Period
Black toner
amount of toner charge: −28 μC/g
fog reflectance: 0.8%
toner scattering: G
graininess level: G
Cyan toner
amount of toner charge: −27 μC/g
fog reflectance: 0.9%
toner scattering: G
graininess level: G
100K-th Copy
Black toner
amount of toner charge: −24 μC/g
fog reflectance: 1.2%
toner scattering: G
graininess level: G
Cyan toner
amount of toner charge: −23 μC/g
fog reflectance: 1.5%
toner scattering: F
graininess level: F As the result of several studies, it was determined that with the employment of the developing apparatus in the second embodiment, a carrier much higher in electrical resistance than the carrier with the highest electrical resistance, with which the developing apparatus in the first embodiment was usable without being reduced in image quality, can be used, making it possible to not only improve the image forming apparatus in terms of the image quality in the standard mode, but also, to reduce the image forming apparatus in terms of the change (deterioration) in image quality attributable to cumulative length of usage.

As described above, according to this embodiment of the present invention, the carrier for the black developer was formulated to be higher in specific resistance than the carrier for each of the color developers, and the replenishment black developer and replenishment color developers were formulated so that the replenishment black developer became higher in carrier ratio than each of the replenishment color developers. Therefore, it was possible to satisfactorily charge the toner in a developing apparatus, in terms of the amount of charge, making it thereby possible to keep an image forming apparatus at a high level in terms of image quality, not only during the initial period of usage, but also, throughout the usage.

More specifically, in this embodiment, the developing apparatus is structured to employ a plurality (two) of development sleeves, and the carrier for the black developer is formulated so that its specific resistance becomes no less than $1.0\times10^{9}$ and no more than $1.0\times10^{12}$, and the carrier for each of the color developers is formulated so that its specific resistance becomes no less than $1.0\times10^{7}$ and no more than $1.0\times10^{9}$. Further, the replenishment black developer is formulated so that its carrier ratio falls in the range of 10–25 wt. %, and each of the replenishment color developers is formulated so that not only does its carrier ratio fall in the range of 1–15 wt. %, but also, it becomes lower than that of the replenishment black developer. Therefore, this embodiment makes it possible to continuously form, for a long period of time, images superior in terms of black development even to the images formed by the image forming apparatus in the first embodiment.

Further, this embodiment increases the amount of charge given to toner, raising the achievable image quality level, reducing fog, reducing the amount by which toner scatters, and also, reducing the amount by which achievable image quality level falls with the increase in the cumulative amount of usage. Therefore, this embodiment makes it possible to reduce the replenishment developer in carrier ratio, being therefore advantageous in terms of operational cost.

As described above, in this embodiment, the carrier for the black developer and the carrier for each of the color developers were formulated so that the former became higher in specific resistance than the latter, and the replenishment black developer and replenishment color developers were formulated so that the former became higher in carrier ratio than the latter. Further, a developing apparatus having a plurality (two) of development sleeves was employed. As a result, toner was given a satisfactory amount of charge not only during the initial period of usage, but also, throughout the usage. Therefore, a high level of image quality was achieved not only during the initial period of image forming operation, but also, throughout the image forming operation, as will be evident from the test results given above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 130319/2004 filed Apr. 26, 2004, which is hereby incorporated by reference.

What is claimed is:

1. An image forming apparatus comprising:

a first developing device containing a black developer including black chromatic toner and a carrier and for developing an electrostatic image with the black chromatic toner, wherein a resistivity of the carrier in the black developer is not less than $1.0\times10^{9}$ Ωcm and not more than $1.0\times10^{10}$ Ωcm;

a first developer supply device for supplying a black supply developer including black chromatic toner and a carrier into said first developing device, wherein a weight ratio of the carrier in the black supply developer is not less than 10 Wt % and not more than 40 Wt %;

a first developer discharging means for discharging the developer from said first developing device;

a second developing device containing a chromatic developer including chromatic toner and a carrier and for developing an electrostatic image with the chromatic toner, wherein a resistivity of the carrier in the chromatic developer is not less than $1.0\times10^{7}$ Ωcm and less than $1.0\times10^{9}$ Ωcm;

a second developer supply device for supplying a chromatic supply developer including chromatic toner and a carrier into said second developing device, wherein a weight ratio of the carrier in the chromatic supply developer is lower than the weight ratio of the carrier in the black supply developer and is not less than 1 Wt % and not more than 15 Wt %; and second developer discharging means for discharging the developer from said second developing device.

2. An image forming apparatus comprising:

a first developing device containing a black developer including black chromatic toner and a carrier and for developing an electrostatic image by carrying the black developer by a plurality of developer carrying members, wherein a resistivity of the carrier in the black developer is not less than $1.0\times10^{9}$ Ωcm and not more than $1.0\times10^{12}$ Ωcm;

a first developer supply device for supplying a black supply developer including black chromatic toner and a carrier into said first developing device, wherein a weight ratio of the carrier in the black supply developer is not less than 10 Wt % and not more than 25 Wt %;

a first developer discharging means for discharging the developer from said first developing device;

a second developing device, containing a chromatic developer including chromatic toner and a carrier, for developing an electrostatic image by carrying the chromatic developer by a plurality of developer carrying members, wherein a resistivity of the carrier in the chromatic developer is not less than $1.0\times10^{7}$ Ωcm and less than $1.0\times10^{9}$ Ωcm;

a second developer supply device for supplying a chromatic supply developer including chromatic toner and a carrier into said second developing device, wherein a weight ratio of the carrier in the chromatic supply developer is lower than the weight ratio of the carrier in the black supply developer and is not less than 1 Wt % and not more than 15 Wt %; and second developer discharging means for discharging the developer from said second developing device.

3. An apparatus according to claims 1 or 2, wherein said black chromatic toner comprises carbon black.

* * * * *

UNITED STATES PATENT AND TRADEMARK OFFICE

CERTIFICATE OF CORRECTION

PATENT NO. : 7,079,795 B2
APPLICATION NO. : 11/114180
DATED : July 18, 2006
INVENTOR(S) : Masaru Hibino It is certified that error appears in the above-identified patent and that said Letters Patent is hereby corrected as shown below:

COLUMN 1:
Line 57, “abovementioned” should read --above-mentioned--.
Line 58, “an” should read --a--.

COLUMN 2:
Line 18, “abovementioned” should read --above-mentioned--.

COLUMN 3:
Line 1, “developer,” should read --developer--.

COLUMN 5:
Line 63, “makes” should read --make--.

COLUMN 8:
Lines 4-5, “peripheral surface 2,” should read --photosensitive drum 2,--.
Line 65, “tricked” should read --trickled--.

COLUMN 9:
Line 25, “inset” should read --inlet--.
Line 52, “of” should read --of a--.

COLUMN 10:
Line 40, “outlet 24” should read --outlet 24b--.
Line 42, “34b” should read --24b--.
Line 61, “above described” should read --above-described--.

COLUMN 11:
Lines 39-40, “above described” should read --above-described--.
Line 65, “abovementioned” should read --above-mentioned--.

COLUMN 12:
Line 33, “it” (first occurrence) should read --it is--.
Line 42, “attributable” should read --attributable to--.
Line 63, “$10^4$-3.0x$10^5$ A/m” should read --$10^4$ A/m--.

COLUMN 13:
Line 5, “of” (second occurrence) should read --of the--.

UNITED STATES PATENT AND TRADEMARK OFFICE

CERTIFICATE OF CORRECTION

PATENT NO. : 7,079,795 B2
APPLICATION NO. : 11/114180
DATED : July 18, 2006
INVENTOR(S) : Masaru Hibino It is certified that error appears in the above-identified patent and that said Letters Patent is hereby corrected as shown below:

COLUMN 18:
Line 28, "specified" should read --specifically--.

COLUMN 19:
Line 30, "structure" should read --structure as--.

COLUMN 22:
Line 25, "to" should read --to the--.

Signed and Sealed this

Twentieth Day of March, 2007

JON W. DUDAS
*Director of the United States Patent and Trademark Office*